United States Patent [19]

Okada

[11] Patent Number: 4,621,489

[45] Date of Patent: Nov. 11, 1986

[54] TEXTILE FABRIC UTILIZING CORED YARNS

[75] Inventor: Hozuma Okada, Kyoto, Japan

[73] Assignee: Sakashita Co., Ltd., Kyoto, Japan

[21] Appl. No.: 721,214

[22] Filed: Apr. 8, 1985

[30] Foreign Application Priority Data

Apr. 7, 1984 [JP] Japan ..... 59-69810

[51] Int. Cl.[4] ..... D03D 15/00; D02G 3/36

[52] U.S. Cl. ..... 57/210; 57/226; 139/426 R

[58] Field of Search ..... 57/200, 210, 224, 225, 57/226, 227, 228, 235; 139/426 R

[56] References Cited

U.S. PATENT DOCUMENTS 2,409,660 10/1946 Briggs ..... 57/210 X
2,607,495 8/1952 Valente ..... 57/235 X
4,191,221 3/1980 Boyer ..... 57/210 X
4,225,442 9/1980 Tremblay et al. ..... 57/210 X
4,365,464 12/1982 Graham et al. ..... 57/210 X

*Primary Examiner*—Donald Watkins
*Attorney, Agent, or Firm*—Wenderoth, Lind & Ponack

[57] ABSTRACT

A textile fabric woven or knitted by the use of cored yarns, each of which cored yarns comprises a thread wadding, composed by a bundle of inner fibers having a high water retentivity, and a thread sheath composed of a plurality of outer fibers arranged exteriorly of the thread wadding so as to substantially completely enclose the inner fibers. The outer fibers has a high moisture permeability and a low water retentivity, and the inner fibers are substantially completely encompassed by the outer fibers in a predetermined thickness while permitted to expand upon absorption of water or moisture vapor.

2 Claims, 27 Drawing Figures

TEXTILE FABRIC UTILIZING CORED YARNS

BACKGROUND OF THE INVENTION

The present invention generally relates a textile fabric made of cored yarns and, more particularly, to an improvement in the cored yarn comprising a thread wadding, composed of a bundle of inner fibers, and a thread sheath composed of a plurality of outer fibers positioned exteriorly of the thread wadding.

FIG. 1 of the accompanying drawing illustrate a cross-sectional profile of the prior art cored yarn 1 on a microscopic scale, which cored yarn 1 consists of a bundle of synthetic inner fibers, made of polyester or acrylic resin and forming a thread wadding 2, and a thread sheath 3 composed of a plurality of outer fibers made of cotton. The outer fibers of the thread sheath 3 are disposed exteriorly of and interlocked with the thread wadding 2 during the manufacture of the cored yarn 1.

It has been found that, when the textile fabric made of the prior art cored yarns is used as a material for sportswear, water vapor originating from human perspiration tends to be wicked by the capillary action into the cotton fibers 3 exteriorly surrounding the thread wadding 2 and is then condensed on the cotton fibers of the thread sheath 3. Therefore, not only is the sportswear uncomfortable to wear when the water vapor so condensed on the cotton fibers of the thread sheath 3 is cooled, but also a wearer who is physically active becomes sweat-soaked.

SUMMARY OF THE INVENTION

Accordingly, the present invention has been developed with a view to substantially eliminating the above discussed disadvantages inherent in the prior art textile fabric made of the above described cored yarns and has for its essential object to provide a textile fabric made of improved cored yarns, which fabric is breatheable and, therefore, the outer fibers which contact the skin of a wearer can be kept substantially dry at all times even though water vapor from perspiration is wicked.

In order to accomplish this object, the present invention makes use of cored yarns, each of which yarns comprises a thread wadding, composed by a bundle of inner fibers having a high water absorbency or a high hygroscopic property, and a thread sheath composed of a plurality of outer fibers arranged exteriorly of the thread wadding so as to substantially completely enclose the inner fibers, said outer fibers having a high water transmission and a high moisture vapor transmission. Specifically, the present invention provides a textile fabric made of the cored yarns each being of a construction wherein the inner fibers having a high water retentivity, that is, a high capability of water holding, are substantially completely encompassed by the outer fibers in a predetermined thickness while permitted to expand upon absorption of water or moisture vapor, said outer fibers having a high water transmission and a low water retentivity.

BRIEF DESCRIPTION OF THE DRAWINGS

This and other objects and features of the present invention will become clear from the following description of preferred embodiments thereof made with reference to the accompanying drawings.

DETAILED DESCRIPTION OF THE EMBODIMENTS

Figure 1:
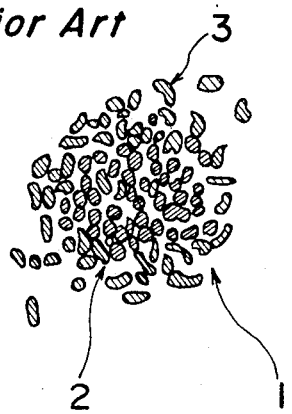
Fig. 1 Prior Art
FIG. 1 is a diagram showing the cross-sectional profile of the prior art cored yarn on a microscopic scale.
Figure 2:
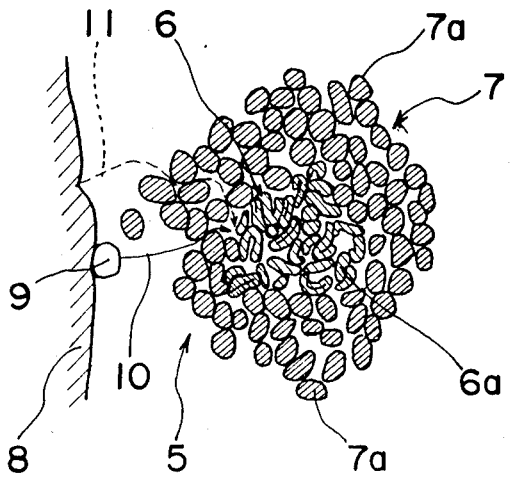
FIG. 2 is a diagram showing the cross-sectional profile on a microscopic scale of a cored yarn according to the present invention, shown in combination with a portion of the skin of a wearer.

Referring particularly to FIG. 2 showing the cross-sectional profile of a cored yarn embodying the present invention which is taken perpendicular to the longitudinal extension thereof, the cored yarn, generally identified by 5, comprises a thread wadding 6 and a thread sheath 7 generally coaxially surrounding the thread wadding 6.

The thread wadding 6 is composed of a bundle of inner fibers 6*a* having a high water retentivity (which means the content of moisture captured by the fibers, expressed in terms of percentage relative to the fibers, and which is associated with the water absorbency and the hygroscopic property), that is, being excellent in water absorbency and hygroscopic property. Each of the fibers 6*a* forming the thread wadding 6 has a thickness smaller than the length thereof and is pliable. These inner fibers 6*a* are loosely bundles as as to have interstices among them so that each of the inner fibers 6*a* can expand upon absorption of water or moisture. Examples of material for the inner fibers 6*a* of the thread wadding 6 include cotton (Water retentivity: 24.0 to 27.0% at 20° C. and 95% humidity), cuprammonium rayon (Water retentivity: 21.0 to 25.0% at the same conditions), rayon (Water retentivity: 25.0 to 30.0% at the same conditions), a water absorbent nylon and acrylic ester. A composite yearn comprising a polyurethane elastic yarn (sold under the trade name "Spandex") and a water absorbent yarn wound around the elastic yarn may also be employed as a material for the thread wadding 6.

On the other hand, the thread sheath 7 positioned exteriorly of and surrounding the thread wadding 6 is composed of a plurality of outer fibers 7*a* having a high water permeability and a low water retentivity, that is, having excellent water transmission and moisture vapor transmission. This thread sheath 7 serves to substantially conceal the thread wadding 6 and has a thickness equal to or greater than a predetermined value sufficient to avoid the possibility that the thread wadding 6 capable of absorbing water and moisture would be exposed to the outside through interstices in the thread wadding 6 to touch, for example, the skin of a wearer. In particular, where the cored yarns according to the present invention is used as a material for a sweat-absorbent fabric, the thread sheath 7 should have a thickness sufficient to avoid the possibility that the thread wadding 6 will, even when somewhat loaded exteriorly of the thread sheath 7, not permit the reverse flow of water or moisture, once absorbed by the thread wadding 6, towards the thread sheath 7. In order to minimize the possible exposure of the thread wadding 6 to the outside through the interstices among outer fibers 7*a* forming the thread sheath 7 which would occur when the cored yarns according to the present invention are knitted or woven to provide a textile fabric or when sportswear made of such knitted or woven fabric using the cored yarns according to the present invention is worn by a wearer, the minimum acceptable thickness of the thread sheath 7 is preferred to correspond to the sum of thicknesses of three of the outer fibers 7*a* encompassing the thread wadding 6.

Examples of material for the outer fibers 7*a* of the thread sheath 7 include polyvinyl chloride (available from Teijin Co., Ltd, of Japan under the trade name "Tevilon". Water retentivity: 0 to 0.3% at 20° C. and 95% humidity. Excellent in moisture permeability and warmth retentivity (a. relative thermal conductivity being 6.4 when that of air is taken 1)), acrylic resin (Water retentivity: 1.0 to 3.0% at the same conditions), polyester (Water retentivity: 0.6 to 0.7% at the same conditions), nylon (Water retentivity: 8.0 to 9.0% at the same conditions), and polypropylene (Water retentivity: 8.0 to 9.0% at the same conditions). Of them, the polyvinyl chloride is most preferred, followed sequentially by the acrylic resin, the polyester, the nylon and the polypropylene.

Figure 17:
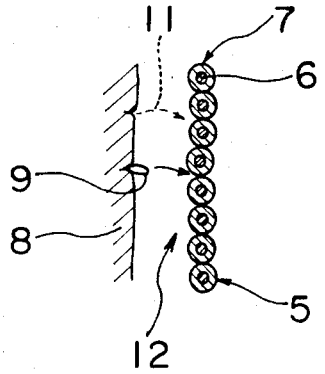
FIG. 17 is a schematic cross-sectional view of a textile fabric according to one embodiment of the present invention.

FIGS. 17 to 20 illustrate different textile fabrics in cross-sectional representation each made by the use of the cored yarns 5 of the construction hereinabove described. Referring first to FIG. 17, the textile fabric shown therein is a single-layered knitted fabric 12 suited as a material for, for example, a sportswear. The textile fabric 12 knitted with the use of the cored yarns 5 functions in the following manner.

As is well known to those skilled in the art, human perspiration excreted from the human body 8 into a generally confined space between the skin and the textile fabric 12 can be broadly classified into water vapor 11 evaporated from the skin and liquid droplets 9 remaining on the skin. human perspiration evaporates to produce water vapor within a generally confined space between the skin. The water vapor 11 emanating from the body 8 pass through the interstices among the outer fibers 7*a* of the thread sheaths 7 and is then absorbed by or condensed upon the inner fibers 6*a* of the thread waddings 6 without substantially wetting the thread sheaths 7. On the other hand, the liquid droplets 9 are soaked in the inner fibers 6*a* of the thread waddings 6 through the interstices among the outer fibers 7*a* of the thread sheaths 7. The liquid droplets 9 so soaked subsequently evaporate from the inner fibers 6*a* of the thread waddings 6 and are then ventilated to the outside atmosphere through the interstices among the outer fibers 7*a* of the thread sheaths 7.

Accordingly, since the water vapor produced from human perspiration within the space between the skin and the knitted textile fabric 12 permeates through the interstices in the thread sheaths 7 and is then absorbed by the thread waddings 6 in the manner as hereinabove described, not only is an air layer within the space not saturated, but also the skin will not be sweat-soaked. In addition, since the evaporation of the liquid droplets condensed upon and absorbed by the thread waddings 6 takes place only in the thread waddings 6, the body 6 will not be affected by both heat evolved by the wetting of the textile fabric and heat of evaporation of the condensed liquid droplets and, therefore, the sportswear is confortable to wear. It is, however, to be noted that the heat of evaporation and the heat evolved by the wetting of the textile fabric depend on the extent to which the textile fabric contacts the skin.

Figure 3A:
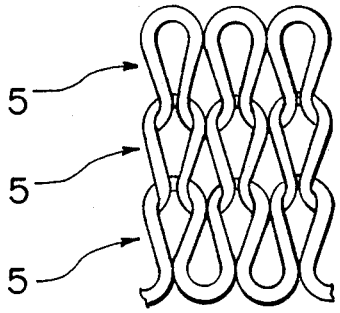
FIGS. 3(*a*) and 3(*b*) are diagrams showing the pattern of plain stitch as viewed from front and rear, respectively.
Figure 3B:
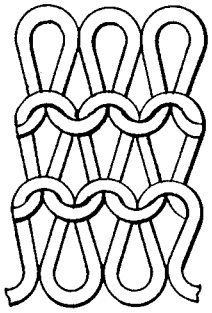

An example of the knitted textile fabric suited as a material for the sportswear is a Kanoko fabric, such as shown in FIGS. 3(*a*) and 3(*b*), wherein cotton is used for the inner fibers 6*a* of the thread waddings 6 and acrylic resin is used for the outer fibers 7*a* of the thread sheaths 7.

Although in the foregoing description the textile fabric prepared by the use of the cored yarns according to the present invention has been described as a material for the sportswear, it is to be noted that the application of the textile fabric prepared by the use of the cored yarns is not limited to that described above, but may include socks, gloves, hair bands, belts, liners for helmets, shoe linings, sheets for chairs, bed sheets, and others which are accessible to the human body. In addition, the moisture may not be always limited to the one produced from human perspiration, but may include that produced by any other water.

According to the foregoing embodiment, since when a water component contacts a surface of the cored yarn 5, the water component can permeate into the thread wadding 6 through the interstices among the outer fibers 7*a* of the thread sheath 7 and is then absorbed by the inner fibers 6*a* of the thread wadding 6, the surface of the cored yarn 5 can be kept substantially dry. Therefore, when one wears sportswear knitted or woven with the use of the cored yarns according to the present invention, water vapor produced from the human perspiration can advantageously be absorbed by the inner fibers 6*a* of the thread waddings 6 through the interstices among the outer fibers 7*a* of the thread sheaths 7 and the surface of the sportswear facing the body skin of the wearer can be kept substantially dry, thereby rendering the sportswear to be comfortable to wear.

Figure 18:
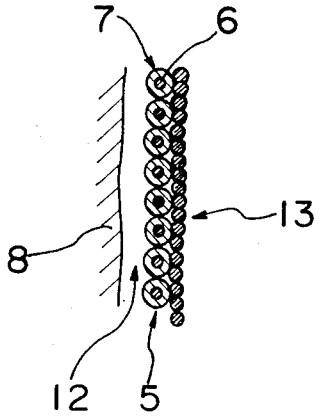
FIGS. 18 to 20 are views similar to FIG. 17, showing different embodiments of the present invention, respectively.
Figure 19:
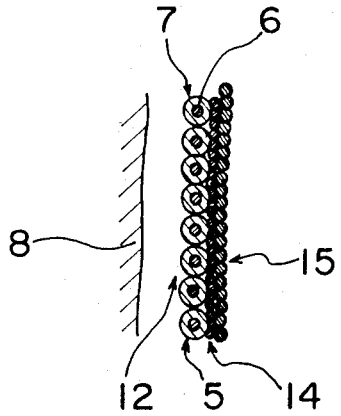

The textile fabric prepared by the use of the cored yarns according to the present invention may not be always limited to the single-layered one such as shown in FIG. 17, but may be interlocked to a surfacing or coating fabric 13 to provide a two-layered cloth such as shown in FIG. 18, or to a surfacing or coating fabric 15 through an intermediate fabric 14 to provide a three-layered cloth such as shown in FIG. 19.

An example of the two-layered cloth shown in FIG. 17 includes a jersey wherein the surfacing fabric 13 is prepared from a knitted fabric made of Tetron-cotton blended yarns, nylon yarns, cotton yarns or polyester yarns. The surfacing fabric 13 may be for the purpose of reinforcing the textile fabric 12 and/or imparting an aesthetic feature.

In the example shown in FIG. 19, the textile fabric 12, the intermediate fabric 14 and the surfacing fabric 15 are all interlocked with each other. The surfacing fabric 15 may be for the purpose of reinforcing the textile fabric 12 and/or imparting an aesthetic feature. The three-layered cloth wherein the intermediate fabric 14 is prepared from cotton yarns and the surfacing fabric 15 is prepared from Tetron-cotton blended yarns or polyester yarns is generally used as a sweat-type cloth. It is to be noted that the intermediate fabric 14 may be a non-woven fabric or, instead of the fabric, a waterproof, moisture absorbent film or a coating layer and, in either case, the intermediate layer 14 can have its opposite surfaces bonded to the fabrics 12 and 15 by the use of any known bonding agent.

Figure 20:
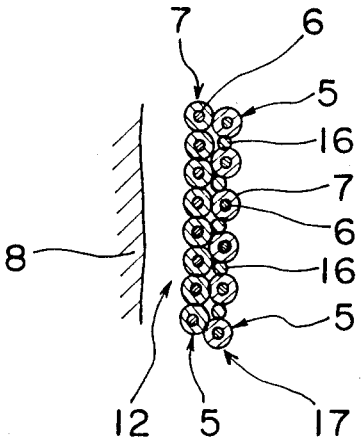

Also, as shown in FIG. 20, the textile fabric 12 knitted by the use of the cored yarns 5 according to the present invention can be interlocked with a surfacing or coating fabric 17 formed by alternately laying down the cored yarns 5 and other suitable yarns 16, thereby to provide a double-layered, so-called Kanoko cloth. The other suitable yarns referred to above may include, for example, polyester, nylon, cotton and acrylic yarns, in which case the resultant double-layered cloth is suited as a material for poloshirts and golfwear. In addition, the resultant double-layered cloth may be used as a material for wristbands in which case the cored yarns used to form the surfacing layer serves to absorb sweat. Moreover, the surfacing layer 17 which is shown as positioned exteriorly of the skin may be positioned interiorly thereof, in which case the use of water-permeable yarns is desirable for the other suitable yarns referred to above.

Figure 21:
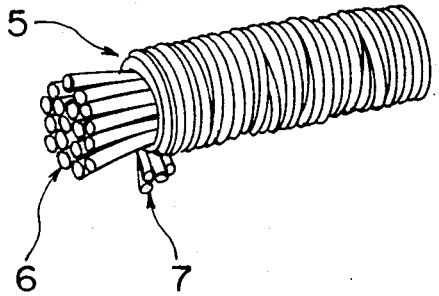
FIGS. 21 to 26 are schematic perspective views showing different forms of the cored yarn according to the present invention, respectively.
Figure 22:
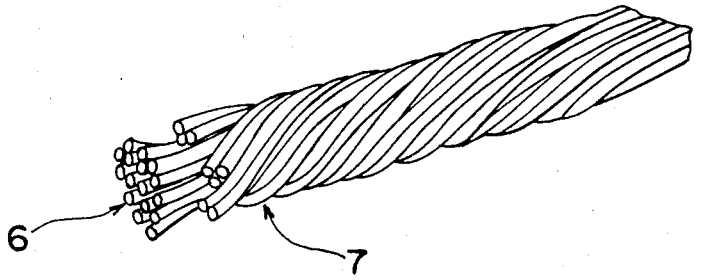
Figure 23:
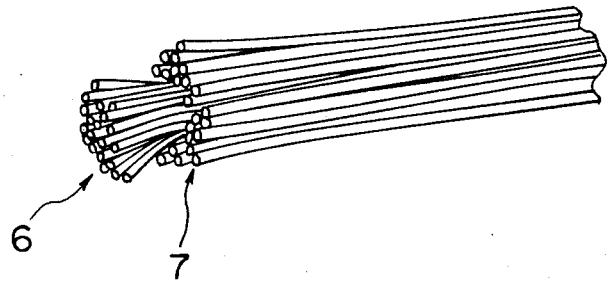
Figure 24:
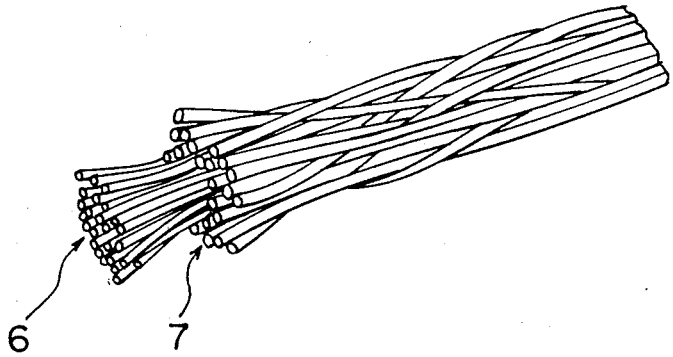
Figure 25:
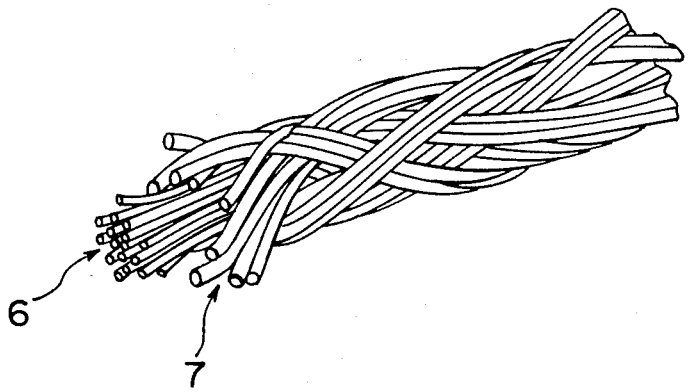
Figure 26:
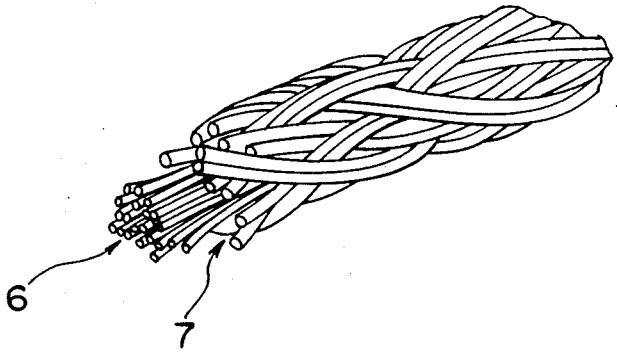

Other than that formed by spinning, the cored yarn according to the present invention may comprise the thread wadding 6 made of filaments and the thread sheath 7 also made of filaments. When the cored yarn according to the present invention is totally made of the filaments as suggested above, as compared with the textile fabric wherein the thread wadding 6 is made of the fibers **6*a* and the thread sheath 7 is made of the fibers 7*a*, the resultant textile fabric will exhibit a high tensile strength and high luster. The filaments useable in the practice of the present invention may include, for example, those made of polyester, nylon, acrylic resin, acetate, polypropylene or polyvinyl chloride for the thread sheath 7, and those made of cuprammonium rayon, modified nylon or water-absorbent nylon for the thread wadding 6**. The textile fabric totally made of these filaments is suited as a material for pantystockings, lingerie, foundations, blouses and other dresses.

Where the filaments are used for both of the thread wadding 6 and the thread sheath 7, the cored yarn may be formed by turning the filaments of the thread sheath 7 around the bundled filaments of the thread wadding 6 as shown in FIG. 21, twisting the filaments of the thread sheath 7 around the bundled filaments of the thread wadding 6 as shown in FIG. 22, or rendering the filaments of the thread sheath 7 to extend parallel to the bundled filaments of the thread wadding 6 as shown in FIG. 23. The cored yarn may also be formed by placing the intertwined filaments of the thread sheath 7 around the bundled filaments of the thread wadding 6 as shown in FIG. 24, or by braiding the filaments of the thread sheath 7 around the bundled filaments of the thread wadding 6 as shown in FIGS. 25 or 26. Although the cored yarn of any one of the structures shown in FIGS. 21 to 26, respectively, can give luster, it gives a different feeling. Specifically, in the example shown in FIG. 23, although it appears that the cored yarn is apt to be loosened or separated, the thread wadding 6 and the thread sheath 7 can be integrated together when the cored yarn of the structure shown in FIG. 23 is interlocked to any other fabric. It is to be noted that the core yarn where it is totally made of the filaments is preferred to have 12 deniers or more.

Although reference has been made to the knitted textile fabric formed by the use of the cored yarns according to the present invention, the cored yarns may be woven to provide a woven textile fabric such as, for example, plain fabric, twill fabric and satin fabric.

As hereinbefore described, since the textile fabric made according to the present invention is breathable in the sense that, when it contacts the skin of the wearer's body, water vapor resulting from human perspiration is allowed to pass through the interstices among the fibers of the thread sheaths 7 and is then absorbed by the bundled fibers of the thread waddings 6 with the fibers of the thread sheaths 7 kept substantially dry and also with the fibers of the thread waddings 6 kept away from the skin, the wearer will not be sweat-soaked. This is in contrast to the conventional textile fabric made by the use of the cored yarns wherein the thread wadding is prepared from acrylic resin and the thread sheath is prepared from cotton, which often causes the wearer to be sweat soaked.

The present invention will be explained by way of illustrative examples which should not be understood as intended to limit the scope of the present invention.

EXPERIMENT I

The cored yarn according to the present invention and the conventional cored yarns were tested as to the surface water residue rate, thermal feel, hygroscopic property and moisture generation rate.

For the purpose of this Experiment, the following four sample fabrics were prepared, all of which are plain knitted fabrics.

Sample (a): Using the commercially available cored yarns sold under the trade name of "Palpa" wherein the thread waddings are made of polyester and the thread sheaths are made of cotton.

Sample (b): Using the commercially available cored yarns sold under the trade name of "Porpolan" wherein the thread waddings are made of acrylic resin and the thread sheaths are made of cotton.

Sample (c): Using the cored yarns according to the present invention wherein the thread waddings are made of cotton and the thread sheaths are made of acrylic resin and wherein the thread wadding and sheath are spun together in a mixing ratio of the weight of the thread wadding relative to that of the thread sheath being 40 to 60.

Sample (d): Using the cotton yarns formed by spinning cotton so as to have the yarn count of No. 30.

(1) Surface Water Residue Rate

Figure 4:
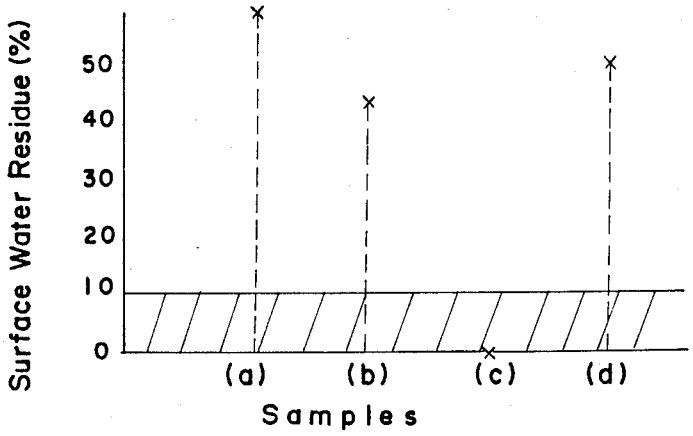
FIGS. 4 and 5 are graphs showing the results of measurement of the amount of surface water residue, that is, the amount of water remaining on the surface, and the results of measurement of the thermal feel, respectively, which are associated with Experiment I.

The surface water residue rate represents the amount (expressed in terms of percentage) of water remaining on the surface of a textile fabric. Experience has shown that, if the surface water residue rate is 10% or lower (as shown by the hatched area in the graph of FIG. 4), it can provide sportswear comfortable to wear.

This surface water residue rate is measured by the following method. Randomly chosen three testpieces, each 10 cm×10 cm in size, of each of the sample fabrics (a) to (d) are allowed to stand in a controlled atmosphere (Temperature: 20±2° C., Relative Humidity: 65±2%) to bring the water content into equilibrium (which testpieces are hereinafter referred to as "controlled testpieces") and, then, the weight of each of the respective controlled testpieces and the weight of each of the blotting papers in standard condition are measured. Thereafter, water in a quantity equal to 1.5 times the weight of each of the testpieces is dropped onto one of the opposite surfaces of the respective testpieces, which is adapted to confront the skin, so as to spread over the entire surface thereof, and the respective testpiece is then allowed to stand for one minute. One minute after the water has been dropped, the weight of the respective testpiece is measured.

After the weight measurement, the blotting paper is placed over the surface of the respective testpiece onto which the water has been dropped and, then, a load of 150 g is applied uniformly over the entire surface of the respective testpiece through the blotting paper, thereby allowing the blotting paper to absorb the water contained in the respective testpiece. The weight of both of the respective blotting paper, which has absorbed the water, and the respective testpieces are then measured. Using the measured values and the following equation, the surface water residue rate can be obtained.

$$[(W_p - W_f)/W_w] \times 100(\%)$$

wherein $W_p$ represents the weight of the blotting paper which has absorbed the water, $W_f$ represents the weight of the controlled testpiece, and $W_w$ represents the weight of the water dropped.

The results of measurement are tabulated in Table 1 below.

TABLE 1

| | Samples | | | |
|---|---|---|---|---|
| | (a) | (b) | (c) | (d) |
| Surface Water Residue Rate (%) | 58 | 42 | 0 | 48 |

From the results of measurement tabulated in Table 1 above, it will readily be seen that the surface water residue rate of the sample (c) according to the present invention is zero, which accounts for the fact that, when sportswear is fabricated with the use of the fabric of the sample (c) no water remains on the surface of the fabric and, therefore, the sportswear is comfortable to wear without the wearer being sweat soaked whereas, when sportswear is fabricated with the use of the fabric of any one of the samples (a), (b) and (d), the wearer tends to be sweat soaked because of water remaining on the surface of the fabric.

(2) Thermal Feel

It is well known that he or she is apt to feel cold and warm to touch metal and a carpet, respectively, even though the temperature remains the same. In other words, the thermal feel perceived by the human sense of touch varies with the type of material touched. This thermal feel is dependent upon the thermal conductivity of the material. In view of the general notion that the thermal feel is acquired about 0.2 second after the material has been touched, the thermal conductivity of the material measured about 0.2 second subsequent to the actual touch is measured to determine the loss of calorie which has taken place per unit surface area and unit time, which loss of calorie is expressed in terms of a q max value and represents the thermal feel.

Figure 5:
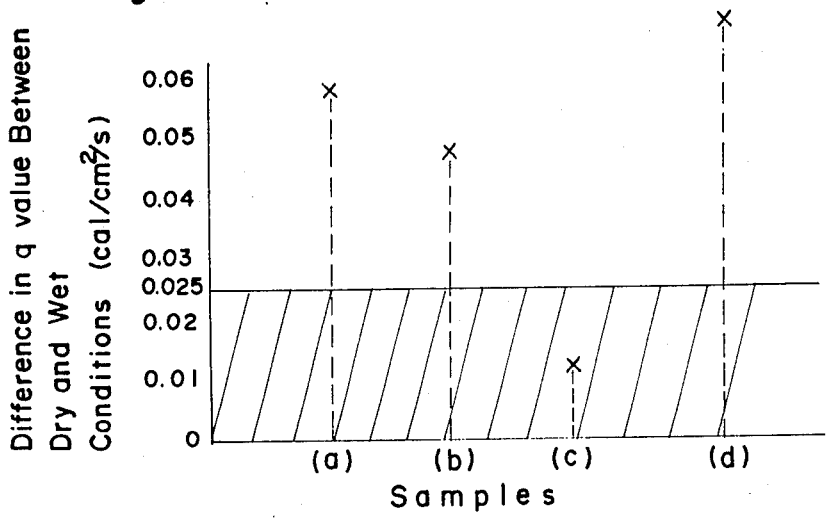

The q max value of the thermal feel accounts that the amount of water remaining on the surface is small when the difference between the wet and dry conditions is small, and when the difference between the wet and dry conditions is not greater than 0.025 cal/cm$^2$/s (as shown by the hatched area in the graph of FIG. 5), a comfort is ensured.

The results of measurement of the thermal feel are tabulated in Table 2 below.

TABLE 2

| | Samples | | | |
|---|---|---|---|---|
| q value | (a) | (b) | (c) | (d) |
| When dry (x) | 0.014 | 0.017 | 0.016 | 0.021 |
| When wet (y) | 0.071 | 0.065 | 0.028 | 0.088 |
| Diff. (x − y) | 0.057 | 0.048 | 0.012 | 0.067 |

From Table 2, it will readily be seen that, in the dry condition, such a fabric as the samples (b) and (d) wherein the water absorbent fibers come outwards from the surface gives a somewhat high q max value, and the type wherein yarns processed to have a water absorbent property or made of water absorbent acrylic resin appears to be felt colder than any regular type.

On the other hand, at the 50% wet condition, the difference thereof becomes great, and the regular acrylic type such as represented by the sample (c) gives the smallest value. This appears to have resulted from the fact that the amount of water remaining on the surface of the sample is small. Accordingly, so far as the difference between the q max value exhibited at the dry condition and that at the 50% wet condition is concerned, the sample (c) has exhibited the smallest value of all. This means that, when sportswear is fabricated with the use of the fabrics of the respective samples (a) to (d), the difference between the thermal feel, given by the sportswear associated with any one of the samples (a), (b) and (d) at the dry condition, and that at the 50% wet condition signifying that the respective sportswear has absorbed water vapor from human perspiration, is great and the respective sportswear having absorbed water vapor from human perspiration is felt cold as compared with that at the dry condition. This is in contrast to the sportswear associated with the sample (c) wherein the difference between the thermal feel at the dry condition and that at the 50% wet condition is small and, even though the sportswear has absorbed water vapor from human perspiration is not felt cold so much as in sportswear associated with the respective samples (a), (b) and (d).

EXPERIMENT II (1) Hygroscopic Property

The hygroscopic property is expressed in terms of the percentage of increase of the weight of each of the samples, prepared in the manner as will be subsequently described, and is measured according to the Kyoto method stipulated by the Japan Kagaku Seni Kensa Kyokai (Association of Chemical Fiber Testing of Japan).

The samples used are as follows.

Sample (e): Circular interlock knitting for use as a material for trainingwear, 20 G in gauge, 480 g/m in weight and 160 cm in width, made by the use of 100% polyester yarns.

Sample (f): Knitted fabric, 20 G in gauge, 421 g/m in weight and 150 cm in width, of double layered structure wherein the surfacing fabric is constituted by a fabric knitted by the use of the cored yarns of the present invention and polyester yarns and the inner fabric, adapted to confront the skin, is knitted by the use of the cored yarns of the present invention, which knitted fabric is for use as a material for trainingwear.

Figure 6:
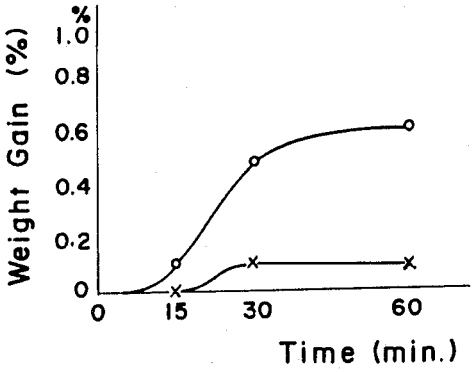
FIGS. 6 and 7 are graphs showing the results of measurement of the hygroscopic property and the results of measurement of the rate of moisture generation, respectively, which are associated with Experiment II.
Figure 7:
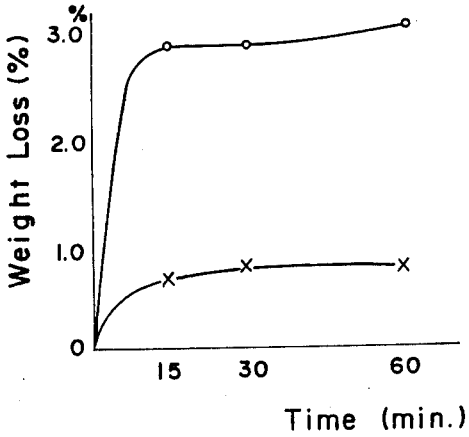

Using these samples (e) and (f), respective testpieces, 1 g in weight, were prepared after the samples had been allowed to stand in a controlled atmosphere (Temperature: 20±2° C., Relative Humidity: 65±2%) to bring the water content into equilibrium (which testpieces are hereinafter referred to as "controlled testpieces") and, then, the weight of each of the respective controlled testpieces was measured. After the weight measurement, the controlled testpieces taken from the samples (e) and (f), respectively, were placed in a desiccator, controlled to 90% in relative humidity and 20° C. in temperature, for a predetermined time (15, 30 and 60 minutes). After the passage of the predetermined time and immediately after the removal from the desiccator, the testpieces were measured as to their weight. Using the measured weight and the following equation, the percentage of increase of the weight was determined.

$$[(W_a - W_b)/W_b] \times 100(\%)$$

wherein $W_a$ represents the weight of each testpieces, which has absorbed humidity, and $W_b$ represents the weight of the respective testpiece prior to being tested. Thus, it will be seen that the more enhanced the tendency to increase the rate of increase of the weight with the passage of time, the better the hygroscopic property. In any event, the results of tests are tabulated in Table 3 and also the graph of FIG. 6.

TABLE 3

| Weight Gain (%) | Samples (e) | Samples (f) |
|---|---|---|
| After 15 mins. | 0 | 0.1 |
| After 30 mins. | 0.1 | 0.5 |
| After 60 mins. | 0.1 | 0.6 |

From Table 3, it will readily be seen that the sample (f) has a better hygroscopic property than that of the sample (e). This means that, when sportswear is fabricated by the use of the fabrics represented by the samples (e) and (f), respectively, the sportswear associated with the sample (e) fails to sufficiently absorb the water vapor from human perspiration, making the wearer sweat soaked and feel uncomfortable to wear, whereas the sportswear associated with the sample (f) is effective to sufficiently absorb the water vapor from human perspiration, making the wearer feel comfortable to wear with a good feel appreciated.

(2) Moisture Dissipating Property

Testpieces, each 1 g in weight, taken from the respective samples (e) and (f), were measured as to their weight, and then placed for 24 hours in a desiccator controlled to 90% in relative humidity and 20° C. in temperature. Immediately after the removal from the desiccator, the weight of each of the testpieces associated respectively with the samples (e) and (f) was measured and, thereafter, the same testpieces were allowed to stand for a predetermined temperature (15, 30 and 60 minutes) in a drier heated to 65° C. After the drying, the weight of each of the testpieces was again measured. Using the measured values and the following equation, the moisture dissipating property was determined in terms of the percentage of decrease in weight.

$$[(W_c - W_d)/W_c] \times 100(\%)$$

wherein $W_c$ represents the weight of each testpiece, which has absorbed humidity, and $W_d$ represents the weight of the respective testpiece subsequent to being tested. Thus, it will be seen that the more enhanced the tendency to decrease the rate of decrease of the weight with the passage of time, the better the moisture dissipating property.

The results of measurement are tabulated in Table 4 below.

TABLE 4

| Weight Loss (%) | Samples (e) | Samples (f) |
|---|---|---|
| After 15 mins. | 0.7 | 2.9 |
| After 30 mins. | 0.8 | 2.9 |
| After 60 mins. | 0.8 | 3.1 |

From Table 4, it will readily be seen that, as compared with the sample (e), the sample has exhibited a high moisture dissipating rate particularly before 15 minutes has passed subsequent to the start of the measurement. This accounts that, while the sportswear fabricated with the fabric associated with the sample (e) tends to become heavy when absorbing water vapor from human perspiration, the sportswear fabricated with the fabric associated with the sample (f) is such that water vapor absorbed by the sportswear is readily dissipated therefrom and, accordingly, the sportswear will not become as heavy as the sportswear fabricated with the fabric associated with the sample (e).

It appears that the sample (f) exhibits a better moisture dissipating property than the sample (e) by the following reason. In the case of the sample (e), the surface tension develops among the fibers by the effect of moisture absorbed by the fibers so that the entire surface of each of the fibers is covered by a film of water with the consequence that the flow of air between the interior and exterior of each fiber is hampered, thereby reducing the moisture dissipating property. In contrast thereto, in the case of the sample (f), since the thread waddings are covered by the thread sheaths as hereinbefore described in connection with the details of the cored yarn according to the present invention, and since, therefore, the surface tension hardly develops among the fibers and between the thread waddings and the thread sheaths, the thread waddings will not be covered exteriorly by a film of water with the flow of air consequently not hampered, thereby exhibiting an excellent moisture dissipating property. In addition, since the partial pressure of the water vapor inside the thread waddings is 100 while that outside the thread waddings is 0 and since no gradient of the partial pressure is consequently developed between the inside and outside of the thread waddings, the water tends to hardly evaporate.

In contrast thereto, in the case of the sample (f), it appears that by the effect of the flow of air between the inside and outside of the thread waddings the partial pressure of the water vapor gradually decreases from the inside of the thread waddings, at which the partial pressure is 100, to the outside of the thread waddings at which the partial pressure is 0, thereby producing the gradient of the partial pressure which, in effect, facilitates the evaporation of the water inside the thread waddings. Moreover, in view of the nature of the yarns used to form the thread waddings, it appears that the water content is greater than that in the sample (e) and the amount of water evaporated is great, and accordingly, the moisture dissipating property is better than that exhibited by the sample (e).

EXPERIMENT 3

The following samples were tested as to the surface water residue rate, the thermal feel, the hygroscopic property and the moisture dissipating rate according to the measuring methods described in Experiments 1 and 2, respectively.

Sample (g): Plain knitted fabric fabricated by the use of the cored yarns of No. 30 in yarn count according to the present invention wherein the thread waddings are made of cotton and the thread sheaths are made of acrylic resin (Monofilaments of 1.8 denier) and wherein the thread wadding and sheath are spun together in a mixing ratio of the weight of the thread sheath relative to that of the thread wadding being 70 to 30.

Sample (h): Same as Sample (g) except that the mixing ratio was 65 to 35.

Sample (i): Same as Sample (g) except that the mixing ratio was 50 to 50.

Sample (j): Same as Sample (g) except that the mixing ratio was 45 to 55.

(1) Surface Water Residue Rate

Figure 8:
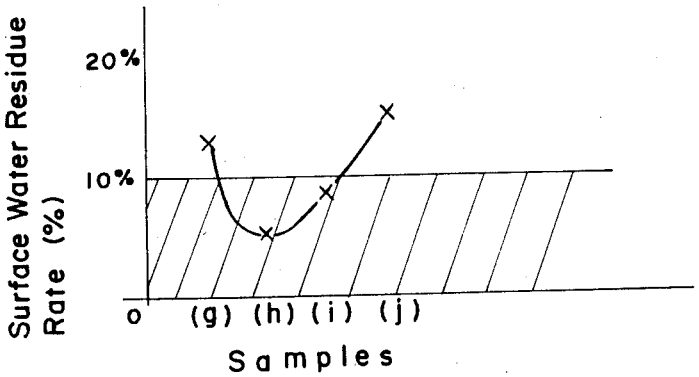
FIGS. 8 to 11 are graphs showing the results of measurement of the surface water residue, that of the thermal feel, that of the hygroscopic property and that of the rate of moisture generation, respectively, which are all associated with Experiment III.

The results of measurement are shown in Table 5 below and also in FIG. 8.

TABLE 5

| | Samples | | | |
|---|---|---|---|---|
| | (g) | (h) | (i) | (j) |
| Surface Water Residue Rate (%) | 13 | 5 | 8 | 15 |

According to the experience, it has been found that sportswear made of the plain fabric exhibiting the surface water residue rate of not higher than 10% appears to be comfortable to wear. Therefore, from Table 5, it appears that the fabric fabricated with the cored yarns each having the mixing ratio of the weight of the acrylic yarns constituting the thread sheath relative to that of the cotton yarns constituting the thread wadding within the range of 69/31 to 48/52, which mixing ratio falls within the hatched area in the graph of FIG. 8.

(2) Thermal Feel

Figure 9:
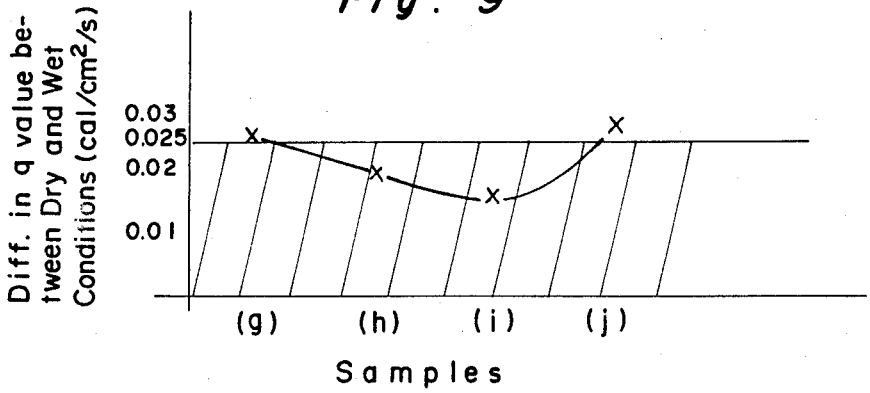

The results of measurement are shown in Table 6 below and also in FIG. 9.

TABLE 6

| | Samples | | | |
|---|---|---|---|---|
| q value | (g) | (h) | (i) | (j) |
| When dry (X) | 0.032 | 0.031 | 0.032 | 0.031 |
| When wet (Y) | 0.058 | 0.051 | 0.049 | 0.059 |
| Diff. (X − Y) | 0.026 | 0.020 | 0.017 | 0.028 |

According to the experience, it has been found that the sportswear fabricated by the use of the plain fabric exhibiting the difference in q value between the dry and wet conditions not greater than 0.025 cal/cm$^2$/s, such as the samples (h) and (i), appears to be comfortable to wear. Therefore, from the graph of FIG. 9, it appears that the fabric fabricated with the cored yarns each having the mixing ratio of the weight of the acrylic yarns constituting the thread sheath relative to that of the cotton yarns constituting the thread wadding within the range of 69/31 to 47/53, which mixing ratio falls within the hatched area in the graph of FIG. 8.

(3) Hygroscopic Property

Figure 10:
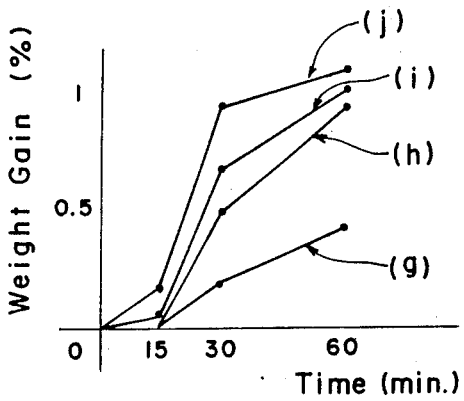

The results of measurement are shown in Table 7 and in FIG. 10.

TABLE 7

| | Samples | | | |
|---|---|---|---|---|
| Water Gain (%) | (g) | (h) | (i) | (j) |
| After 15 mins. | 0.0 | 0.0 | 0.1 | 0.3 |
| After 30 mins. | 0.2 | 0.5 | 0.7 | 0.9 |
| After 60 mins. | 0.4 | 0.9 | 1.0 | 1.2 |

While the samples (h), (i) and (j) have shown a similar weight gain, that is, increase in weight, the weight gain exhibited by the sample (g) although seemingly inferior to any one of the samples (h), (i) and (j) is better than the sample (e) employed in Experiment 2 and associated with the prior art material. Accordingly, it may be said that all of the samples (g) to (j) are superior to any one of the prior art materials.

(4) Moisture Dissipating Rate

Figure 11:
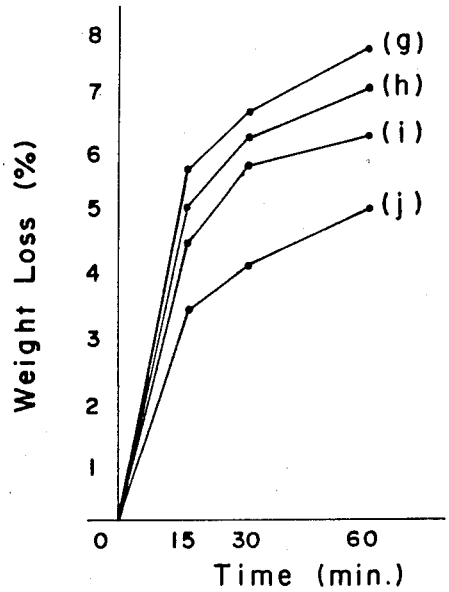

The results of measurement are shown in Table 8 below and FIG. 11.

TABLE 8

| | Samples | | | |
|---|---|---|---|---|
| Weight Loss (%) | (g) | (h) | (i) | (j) |
| After 15 mins. | 5.7 | 5.1 | 4.6 | 3.5 |
| After 30 mins. | 6.7 | 6.3 | 5.9 | 4.3 |
| After 60 mins. | 7.9 | 7.1 | 6.4 | 5.2 |

While the samples (g), (h) and (i) have shown a similar weight loss, that is, decrease in weight, the weight loss exhibited by the sample (j) although approximating to the weight loss exhibited by the samples (g), (h) and (i). In any event, the weight loss exhibited by any one of the samples (g) to (j) is greater than that exhibited by the sample (e) associated with the prior art material, and accordingly, all of the samples (g) to (j) can be considered superior to the prior art materials.

EXPERIMENT 4

The following samples were tested as to the surface water residue rate, the thermal feel, the hygroscopic property and the moisture dissipating rate.

Sample (k): Plain knitted fabric fabricated by the use of the cored yarns No. 30 in yarn count according to the present invention wherein the thread waddings are made of cotton and the thread sheaths are made of acrylic resin (Monofilaments of 1.8 denier) and wherein the mixing ratio of the weight of the thread sheath relative to that of the thread wadding was 70 to 30.

Sample (l): Same as Sample (k) except that the yarn count is No. 50 and the acrylic monofilament for the thread sheath is 1.2 denier.

Sample (m): Same as Sample (k) except that the yarn count is No. 80 and the acrylic monofilament for the thread sheath is 1.0 denier.

Figure 12:
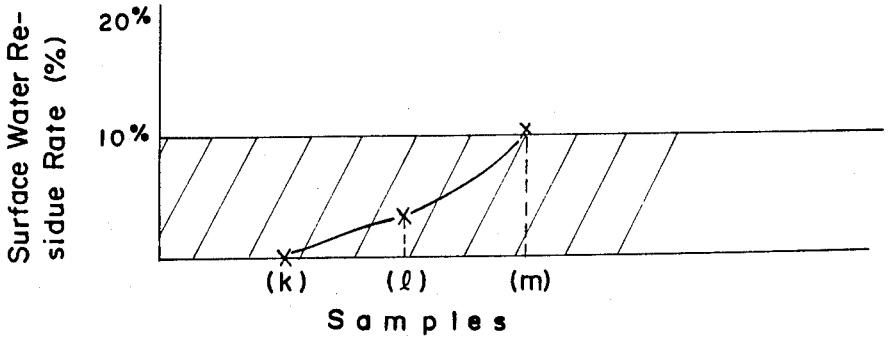
FIGS. 12 to 15 are graphs similar to FIGS. 8 to 11, respectively, but associated with Experiment IV.

The results of measurement are shown in Table 9 below and also in FIG. 12 (Surface water residue rate), FIG. 13 (Thermal feel), FIG. 14 (Hygroscopic property) and FIG. 15 (Moisture dissipating property).

TABLE 9

| | | Samples | | |
|---|---|---|---|---|
| | | (k) | (l) | (m) |
| Surface Water Residue Rate (%) | | 0 | 3 | 11 |
| Diff. in q max value Between Wet & Dry Conditions (cal/cm²/s) | | 0.012 | 0.015 | 0.028 |
| Moisture Absorbency (Water Gain %) | After 15 mins. | 0.0 | 0.0 | 0.0 |
| | After 30 mins. | 0.6 | 0.5 | 0.45 |
| | After 60 mins. | 0.8 | 0.75 | 0.7 |
| Moisture Dissipating Property (Weight Loss %) | After 15 mins. | 4.3 | 4.1 | 4.4 |
| | After 30 mins. | 4.9 | 5.8 | 6.1 |
| | After 60 mins. | 5.8 | 6.5 | 6.8 |

With respect to the surface water residue rate, all of the sample (k) to (m) have shown the value not higher than 10% and are effective to provide the textile fabric comfortable to wear. It, therefore, appears that the uppermost limit of the yarn count and the lowermost limit of the denier are those of the sample (m) as can be seen from the graph of FIG. 12.

Figure 13:
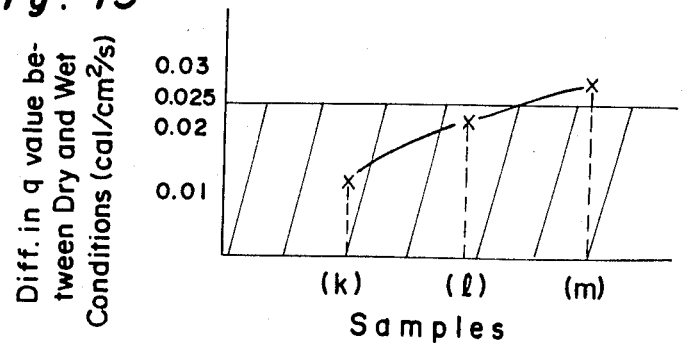

With respect to the thermal feel, the samples (k) and (l) have shown the value not higher than 0.025 cal/cm²/s, and from the graph of FIG. 13 it will readily be seen that the uppermost limit of the yarn count appears to be No. 60.

Figure 14:
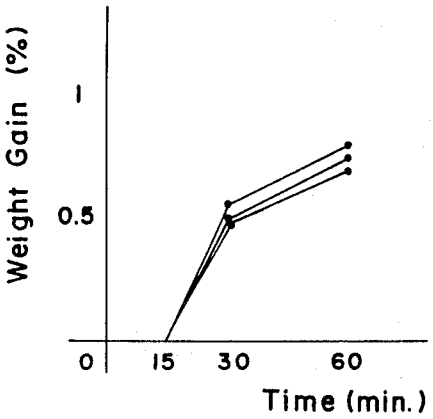
Figure 15:
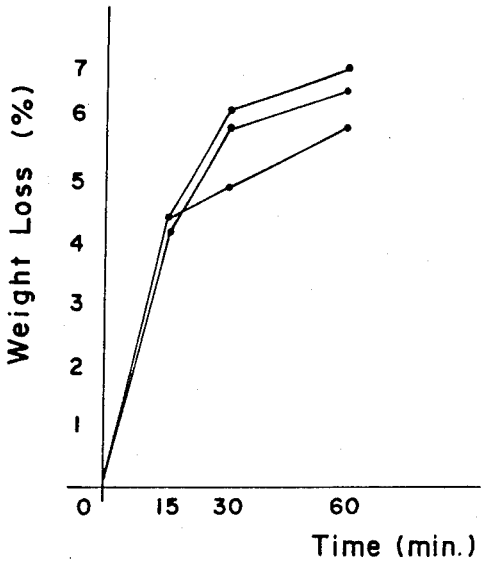

With respect to the hygroscopic property, since all of the samples (k) to (m) have exhibited a similar weight gain as shown in FIG. 14, it appears that all of them have a similar performance.

With respect to the moisture dissipating property, the samples (l) and (m) have shown a similar weight loss and the sample (k) has shown a weight loss approximating to that exhibited by the samples (l) and (m). Accordingly, it appears that all of the samples (k) to (m) have a similar performance.

EXPERIMENT 5

The correlationship between the performance of the cored yarn and the denier of the acrylic monofilament forming the thread sheath was measured. For this purpose, the cored yarns wherein the mixing weight ratio of the cotton thread wadding relative to the acrylic thread sheath is 60 to 40, but having yarn counts of No. 30 and No. 50, respectively, were prepared so as to render the acrylic monofilament to have a denier within the range of 1.0 to 3.0, and then, the difference in q values between the wet and dry conditions was measured, the results of which are shown in Table 10 below and in FIG. 16.

TABLE 10

| Monofilament Denier | | 1.0 | 1.2 | 1.5 | 1.7 | 2.0 | 2.2 | 2.5 | 3.0 |
|---|---|---|---|---|---|---|---|---|---|
| Diff. in q Value Between Wet & Dry Conditions (cal/cm²/s) | Yarn Count No. 30 | 0.015 | 0.018 | 0.014 | 0.016 | 0.018 | 0.023 | 0.027 | 0.038 |
| | Yarn Count No. 50 | 0.016 | 0.015 | 0.027 | 0.031 | 0.033 | 0.034 | 0.039 | 0.047 |

Figure 16:
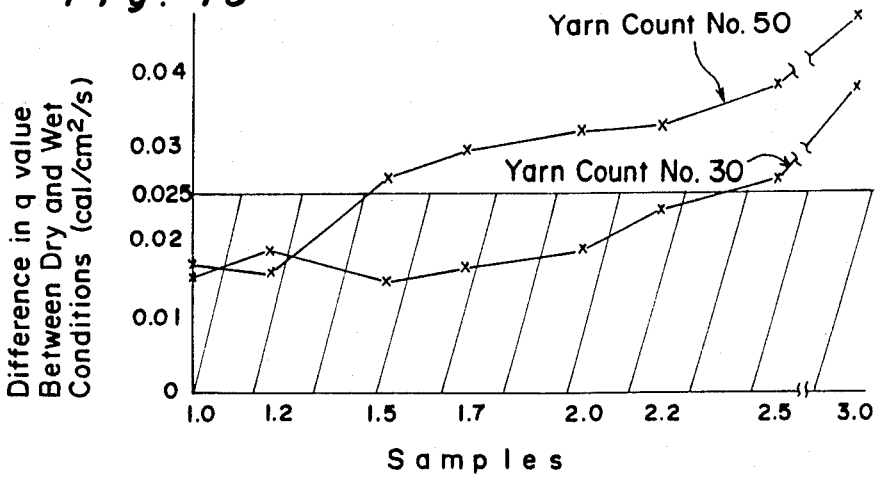
FIG. 16 is a graph showing the results of measurement of the thermal feel associated with Experiment V.

From Table 10 above and the graph of FIG. 16, it will readily be seen that, if the cored yarn of No. 30 in yarn count employs the acrylic monofilaments within the range of about 1.0 to about 2.3 deniers, or if the cored yarn of No. 50 in yarn about employs the acrylic monofilaments within the range of about 1.0 to about 1.4 for the yarn count No. 50, the difference in q value does not exceed 0.025 cal/cm²/s and, therefore, the cored yarn can provide a textile fabric effective to ensure the comfort. Judging from the graph of FIG. 16, in the case of the yarn count No. 30, the performance of the cored yarns according to the present invention will be maximized if the acrylic monofilaments of 1.7 to 1.8 denier are used. On the other hand, in the case of the yarn count No. 50, the performance of the cored yarns according to the present invention will be maximized if the acrylic monofilaments of up to 1.2 denier are employed.

The number of the acrylic monofilaments of 1.8 denier used to form the thread sheath in the cored yarn (hereinafter referred to as "30-1.8 Cored Yarn") wherein the thread wadding is composed of the cotton yarns of No. 30 in yarn count and the number of the acrylic monofilaments of 1.2 denier used to form the thread sheath in the cored yarn (hereinafter referred to as "50-1.2 Cored Yarn") wherein the thread wadding is composed of the cotton yarns of No. 50 in yarn count will now be calculated.

In the case of 30-1.8 Cored Yarn, the percentage of the weight of the acrylic monofilaments relative to the weight of the cotton yarns forming the thread wadding is 60 wt% if the mixing weight ratio thereof is 60/40.

When the yarn count is converted into the unit of denier, the yarn count No. 30 corresponds to 177 deniers. Hence; 60 wt% of the acrylic monofilaments corresponds to $177 \times 0.6 = 106.2$. Since each acrylic monofilament has 1.8 denier as described above, the use of 60 wt% of the acrylic monofilaments in the 30-1.8 Cored Yarn means that 59 acrylic monofilaments are used, that is, $106.2 \div 1.8 = 59$.

Similarly, in the case of 50-1.2 Corned Yarn, the conversion of the yarn count No. 50 results in 106 deniers, and 60 wt% of the acrylic monofilaments correponds to 63.6. Hence, considering that each acrylic monofilaments has 1.2 denier as described above, the use of 60 wt% of the acrylic monofilaments in the 50-1.2 Cored Yarn means that 53 acrylic monofilaments are used.

From the foregoing, both of the cored yarns of No. 30 and No. 50 in yarn count employ not less than 50 acrylic monofilaments for the thread sheath and, accordingly, in order for the cored yarn having a yarn count within the range of No. 30 to No. 50 to exhibit the highest thermal feel, the number of the acrylic monofilaments used for the thread sheath is required to be not less than 50. It is to be noted that in the cored yarn of No. 30 in yarn count the minimum thickness of the thread sheath has been found corresponding to the sum of the thickness of three of the acrylic monofilaments.

Based on the results of measurement according to the foregoing Experiments 3, 4 and 5, it has been found that in order for the surface water residue rate to be kept at a value not higher than 10%, the cored yarn must be of a type wherein the ratio of the weight of the cotton yarns relative to that of the acrylic filaments (Acrylic Filament/Cotton Yarn) is within the range of 69/31 to 48/52, the yarn count must be within the range of No. 30 to No. 80 and each acrylic monofilament must have a denier within the range of 1.8 to 1.0. In addition, in order for the difference in q value between the wet and dry conditions to be not higher than 0.025 cal/cm$^2$/s, the ratio of the weight of the cotton yarn relative to that of the acrylic monofilaments must be within the range of 69/31 to 47/53 and, at the same time, the yarn count must not exceed No. 60 while each acrylic monofilament has a denier within the range of 1.0 to 2.3.

Summarizing the above, for the purpose of the present invention, the cored yarn is preferred to have an Acrylic Filament/Cotton Yarn ratio within the range of 69/31 to 48/52 with each acrylic monofilament having a denier within the range of 1.0 to 2.3 while the yarn count is not greater than No. 60.

Although the present invention has fully been described in connection with the numerous preferred embodiments thereof, it is to be noted that various changes and modifications are apparent to those skilled in the art. Such changes and modifications are to be understood as included within the scope of the present invention as defined by the appended claims unless they depart therefrom.

What is claimed is:

1. A textile fabric woven or knitted by the use of cored yarns, each of said cored yarns comprising a thread wadding, composed by a bundle of inner fibers having a high water retentivity, and a thread sheath composed of a plurality of outer fibers arranged exteriorly of the thread wadding so as to substantially completely enclose the inner fibers, said outer fibers having a high moisture permeability and a low water retentivity, said inner fibers being substantially completely encompassed by the outer fibers in a predetermined thickness while permitted to expand upon absorption of water or moisture vapor and wherein the ratio of the weight of the inner fibers relative to that of the outer fibers is within the range of 69/31 to 48/52, and wherein each of said outer fibers has a denier within the range of 1.0 to 2.3, and each of said cored yarn has a yarn count of not greater than No. 60.

2. A textile fabric as claimed in claim 1, wherein the inner fibers are made of cotton and the outer fibers are made of a material selected from the group consisting of acrylic resin and polyester.

* * * * *